United States Patent [19]

Uehara et al.

[11] 3,978,869

[45] Sept. 7, 1976

[54] MOUTHPIECE FOR CIGARETTE

[75] Inventors: Minoru Uehara; Kazuo Maeda, both of Tokyo; Shoji Fujii, Ichikawa; Hiromu Nishio, Kamakura, all of Japan

[73] Assignees: The Japan Monopoly Corporation, Tokyo; Daicel, Ltd., Osaka, both of Japan

[22] Filed: June 19, 1975

[21] Appl. No.: 589,364

Related U.S. Application Data

[63] Continuation of Ser. No. 419,439, Nov. 27, 1973, abandoned.

[30] Foreign Application Priority Data

Nov. 28, 1972 Japan ..... 47-136791[U]

[52] U.S. Cl. ..... 131/261 B; 131/209

[51] Int. Cl.[2] ..... A24F 13/06

[58] Field of Search ..... 131/10.5, 209, 217, 131/261 B, 210, 265

[56] References Cited

UNITED STATES PATENTS

| | | | |
|---|---|---|---|
| 879,796 | 2/1908 | Plane | 131/210 |
| 966,021 | 8/1910 | Jansson | 131/209 |
| 1,413,580 | 4/1922 | Gruen | 131/217 |
| 1,646,320 | 10/1927 | Shuler | 131/209 X |
| 1,706,398 | 3/1929 | Caldwell | 131/209 X |
| 1,951,665 | 3/1934 | Longrie | 131/209 X |
| 2,354,388 | 7/1944 | Lewis | 131/203 |
| 2,703,088 | 3/1955 | Mitchell | 131/10.5 |
| 3,299,895 | 1/1967 | Dearsley | 131/261 B |
| 3,395,713 | 8/1968 | Ent-Keller | 131/261 B X |
| 3,396,733 | 8/1968 | Allseits et al. | 131/10.5 |

FOREIGN PATENTS OR APPLICATIONS

| | | | |
|---|---|---|---|
| 69,752 | 8/1941 | Czechoslovakia | 131/10.5 |
| 823,690 | 11/1959 | United Kingdom | 131/265 |
| 13,785 | 1906 | United Kingdom | 131/217 |
| 2,980 | 1884 | United Kingdom | 31/261 B |

*Primary Examiner*—John F. Pitrelli

*Attorney, Agent, or Firm*—Woodhams, Blanchard and Flynn

[57] ABSTRACT

A mouthpiece for cigarettes comprising a tubular exterior cylinder of substantially circular cross-section obtained by extrusion molding of synthetic resin and having at least one deflecting wall extending inwardly from the inner surface of said exterior cylinder, and the juncture of said deflecting wall with the inner surface of said exterior cylinder being formed in a helix about the central longitudinal axis of said exterior cylinder.

1 Claim, 4 Drawing Figures

MOUTHPIECE FOR CIGARETTE

This is a continuation of application Ser. No. 419,439 filed Nov. 27, 1973, now abandoned.

BACKGROUND OF THE INVENTION

1. Field of the Invention

This invention relates to a cigarette mouthpiece which can be attached to a cigarette in combination with a filter.

More particularly, it relates to a cigarette mouthpiece wherein the smoke passage inside of a tubular exterior cylinder has the form of a helix so that the smoke passing through said passage flows through a helical path about the central longitudinal axis of the exterior cylinder. The fine particles of condensable components in the smoke are thereby efficiently separated from the gaseous components, while the collision and adhesion of said particles to the passage wall are effectively enhanced.

2. Description of the Prior Art

A conventional filter for cigarettes contains filter medium of fibrous material which is wrapped with an external paper layer to form a filter tip and the filter tip is attached to the cigarette. The fiber initially employed for cigarette filters was cotton and later a filter tip comprised of acetate tow was used.

The essential functional requirement of cigarette filters is that they should remove the smoke components considered by smokers as being undesirable for reasons of aroma, taste and/or health. Therefore, a great many cigarette filter devices has been proposed for achieving the proper balance between the suction resistance or the pressure drop in the passage of cigarette smoke components through the filter and the amount of unwanted smoke components removed by the filter.

Different types of filter materials are currently available which are designed to enhance the adsorption efficiency principally. These include non-acetate fibers such as rayon and paper, combinations of different types of fibers such as acetate-paper mixtures, or combinations containing activated charcoal.

Furthermore various types of filter tips are available, for example, a device for introducing ambient air into the upstream side of the filter tip thus lowering the temperature of the smoke components reaching the mouth of the smoker and retarding the combustion of the cigarette tobacco, and/or a plastic mouthpiece for enhancing the self-supporting effect of the filter tip and having dimensions and shape providing a pleasing feel on the smoker's lips and also a mouthpiece having a baffle or the like for separating the condensable components which form as the smoke cools during its passage from the combustion zone to the mouthpiece so as to deposit said condensed components on the inner surface of the mouthpiece, thereby improving the absorption coefficient (removal of condensed components) to some extent.

One example of a known cigarette mouthpiece of this type comprises a mouthpiece (hereinafter referred to as "straight type") wherein an axially extending straight wall or partition is provided inside a thin exterior tube, thereby dividing the interior of said tube into at least two parallel smoke passages. Another known mouthpiece (hereinafter referred to as "baffle type" as shown in FIGS. 1 and 2) has axially spaced walls inside the tube and extending perpendicular to the axis thereof. These walls are provided with transversely offset through holes so that said walls serve as baffles and the smoke flows through a zig-zag path.

Although a mouthpiece of the "straight type" has only a small pressure drop during smoking, it also has only a minor effect of separating and depositing smoke components on the surfaces of mouthpiece so that this type of mouthpiece provides primarily only an improved feel in the mouth of the smoker. On the other hand, a mouthpiece of the "baffle type" has an effect of separating condensible smoke components, but because of the complicated shape of its smoke passage, the pressure drop thereacross is relatively high so that a stronger suction must be applied by the smoker. For example, when smoke is drawn through the exterior cylinder 1 in the direction A as shown in FIG. 1, the stream undergoes a total pressure drop several times as large as the drop that occurs when only one wall is present. The total pressure drop comprises an iris loss at the entrance position 4 between two adjacent partition walls 2, a divergence loss at the outlet position 5, and a pressure loss due to the change of direction between said outlet position 5 and the subsequent entrance position 6. Therefore the advantages and disadvantages of this "baffle type" mouthpiece are contrary to those of the "straight type" mouthpiece.

SUMMARY OF THE INVENTION

The cigarette mouthpiece of the present invention comprises an exterior hollow cylinder of circular cross section, obtained by extrusion molding of synthetic resin, and having at least one deflecting wall bonded to the inner surface of said exterior cylinder. The deflecting wall is helical so that along its lengthwise extent it occupies substantially all the radii of said exterior cylinder. The juncture of said deflecting wall with the inner surface of said exterior cylinder is formed in a helix about the central longitudinal axis of said exterior cylinder.

Figure 1:
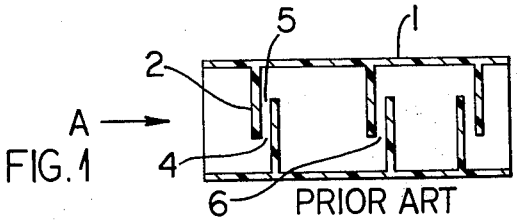
FIG. 1 is a longitudinal cross section of a conventional cigarette mouthpiece of the "baffle type".
Figure 2:
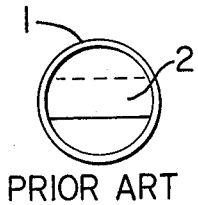
FIG. 2 is an end view of the mouthpiece of FIG. 1.
Figure 3:
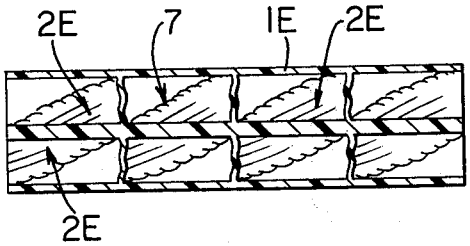
FIG. 3 is a longitudinal cross section of another embodiment of the present invention.
Figure 4:
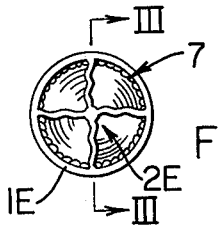
FIG. 4 is an end view of the embodiment shown in FIG. 3.

In the embodiment of the invention illustrated in FIGS. 3–4, the reference numeral 1E identifies the exterior hollow cylinder of circular cross-section, 2E is the deflecting wall.

The invention has an internal deflecting wall 2E of helical shape inside the exterior cylinder. The deflecting wall 2E is made of a quadruple helix (FIGS. 3 and 4). A mouthpiece according to the present invention provides a smaller pressure drop than a mouthpiece of the known "baffle type". This is because the smoke flows through a passage or passages of substantially constant size and it is subjected to only smooth and gradual direction change as it passes through the mouthpiece. However, the helically revolving stream of smoke has extensive contact with surfaces of the mouthpiece to promote condensation and separation of condensed drops of smoke components and facilitate their adhesion onto the passage surfaces. The cigarette mouthpiece according to the present invention by virtue of its helical deflecting or partition wall 2E can easily have at least about twice as much wall area, for the same axial length, as the known "straight type" mouthpiece having the same number of walls. Also the smoke components are cooled by passing through a passage having a greater length than the passage in the "straight type" mouthpiece, thereby producing a larger amount of condensed components, thus accomplishing an excellent separation of unwanted components and adhesion thereof to the surfaces of the mouthpiece.

In addition, the amount of the condensate can be further increased by employing a mouthpiece as shown in FIGS. 3 and 4 wherein plaits or pleats of about 1 mm in width and spaced-apart axially a distance of about 1 mm are formed along the junctures of the deflecting walls 2E and the exterior cylinder. Also, the deflecting walls can have a wavy or corrugated shape in cross-section (FIG. 4). In this case, the filtration efficiency and condensate removal can be enhanced so as to be similar to that of a cigarette filter of acetate fiber tows prepared according to the U.S. Pat. No. 2,794,239.

Thus, in FIGS. 3 and 4, there is shown a one-piece, extruded, synthetic resin, cigarette mouthpiece having a cylindrical tubular exterior wall 1E of substantially circular cross-section. There are four continuous unitary helical deflecting walls 2E within the exterior wall 1E and extending lengthwise from one axial end to the other axial end of said exterior wall. As shown in FIG. 4, the four deflecting walls 2E, in transverse cross-section, extend substantially radially inwardly from substantially uniformly circumferentially spaced-apart points on the exterior wall 1E. The deflecting walls 2E intersect and are joined to each other at their radially inner ends at the central longitudinal axis of the mouthpiece so that the deflecting walls 2E form a cross in transverse cross-section. The deflecting walls 2E are helically curved along the entire lengthwise extent of the mouthpiece so that all radii of the circular cross-section of the mouthpiece defined by said exterior wall are occupied by portions of said deflecting walls along the length of the mouthpiece. The radially outer edges of the deflecting walls 2E are integral with the exterior wall 1E. The deflecting walls 2E define within the exterior wall 1E four continuous helical flow passages for cigarette smoke so that the cigarette smoke undergoes smooth and gradual direction change as it flows through said passages. The deflecting walls 2E have axially spaced-apart pleats 7 extending from the junctures of the radially outer edges thereof with the exterior wall 1E. The pleats 7 extend partway across the deflecting walls 1E. The deflecting walls also have longitudinally extending corrugations so that each of the deflecting walls has a wavy configurate in transverse cross-section (FIG. 4).

With regard to the mouthpiece of the present invention, the efficiency of removing nicotine is smaller than that of said acetate filter so as not to worsen the smoke aroma, but noxious components such as phenol, benzene, toluene and cyanic acid can be removed better.

The pitch of the helical deflecting wall can be constant or it can vary along the length of the exterior cylinder.

A preferred method for preparing a mouthpiece according to the present invention is an extrusion molding process, in which a first tubular extrudate stream forming the exterior cylinder is joined with a second extrudate stream forming the deflecting wall and arranged inside said first stream. The extrusion die for the second stream is rotated about an axis coaxial with the extrusion direction to form the helical configuration of the deflecting wall. The mouthpiece with pleats shown in FIGS. 3 and 4 can be prepared by the same process except that the extruding conditions, such as temperature and speed, are changed, for example, by making the speed of the second stream slightly faster than the speed of the first stream to effect a slightly irregular joining of the two streams.

The embodiments of the invention in which an exclusive property or privilege is claimed are defined as follows:

1. A one-piece, extruded, synthetic resin, cigarette mouthpiece having a cylindrical tubular exterior wall of substantially circular cross-section, and four continuous unitary helical deflecting walls within said exterior wall and extending lengthwise from one axial end to the other axial end of said exterior wall, said four deflecting walls in transverse cross-section extending substantially radially inwardly from substantially uniformly circumferentially spaced-apart points on said exterior wall, said deflecting walls being joined to each other at their radially inner ends at the central longitudinal axis of said mouthpiece so that said deflecting walls form a cross in transverse cross-section, said deflecting walls being helically curved along the entire lengthwise extent of said mouthpiece so that all radii of the circular cross-section of the mouthpiece defined by said exterior wall are occupied by portions of said deflecting walls along the length of the mouthpiece, the radially outer edges of said deflecting walls being integral with said exterior wall, said deflecting walls defining within said exterior wall four separate continuous helical flow passages for cigarette smoke so that said cigarette smoke undergoes smooth and gradual direction change as it flows through said passages, said deflecting walls each having axially spaced-apart pleats extending from the junctures of the radially outer edges thereof with said exterior wall part-way across said deflecting walls and also having longitudinally extending corrugations so that each of said deflecting walls has a wavy configuration in transverse cross-section.

* * * * *